US010252544B2

(12) United States Patent
Cassoni et al.

(10) Patent No.: US 10,252,544 B2
(45) Date of Patent: Apr. 9, 2019

(54) APPARATUS AND METHOD FOR DEPOSITING A SUBSTANCE ON ARTICLES

(71) Applicant: The Procter & Gamble Company, Cincinnati, OH (US)

(72) Inventors: Robert Paul Cassoni, Waynesville, OH (US); Matthew Richard Allen, Mason, OH (US); John Randel LaCaze, Hampton Cove, AL (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/935,471

(22) Filed: Nov. 9, 2015

(65) Prior Publication Data

US 2016/0136966 A1 May 19, 2016

Related U.S. Application Data

(60) Provisional application No. 62/078,988, filed on Nov. 13, 2014.

(51) Int. Cl.

| | |
|---|---|
| ***B41J 2/01*** | (2006.01) |
| ***B41J 3/407*** | (2006.01) |
| *B41M 5/00* | (2006.01) |

(52) U.S. Cl.

CPC ..... *B41J 3/4073* (2013.01); *B41J 2/01* (2013.01); *B41M 5/0088* (2013.01)

(58) Field of Classification Search

None

See application file for complete search history.

(56) References Cited

U.S. PATENT DOCUMENTS 6,135,654 A 10/2000 Jennel
6,209,459 B1 4/2001 Kaufman
(Continued)

FOREIGN PATENT DOCUMENTS

EP 1163156 A1 * 12/2001 ..... B65B 61/26
EP 1163156 B1 11/2003
(Continued)

OTHER PUBLICATIONS

International Search Report and Written Opinion dated Jan. 14, 2016, 13 pgs, U.S. Appl. No. 14/935,474.
(Continued)

*Primary Examiner* — Erica S Lin
(74) *Attorney, Agent, or Firm* — Sarah M DeCristofaro; Jason J Camp

(57) ABSTRACT

Apparatuses and methods for depositing a substance onto an article are disclosed, including apparatuses and methods of directly printing on three-dimensional articles, as well as the articles printed thereby or having a substance deposited thereon. In some cases, the apparatuses and methods involve creating a re-circulating relative motion between at least one article and a substance deposition device. In some embodiments, the articles can be conveyed in a closed loop path past one or more substance deposition devices. The articles can be conveyed past the substance deposition device(s) one or more times, and during each pass by the substance deposition device(s), a portion of a predetermined pattern may be applied to the articles by the substance deposition device(s).

31 Claims, 5 Drawing Sheets

(56) References Cited

U.S. PATENT DOCUMENTS

| | | | | |
|---|---|---|---|---|
| 6,699,352 | B2 | 3/2004 | Sawatsky | |
| 7,210,408 | B2 | 5/2007 | Uptergrove | |
| 7,467,847 | B2 | 12/2008 | Baxter et al. | |
| 7,737,349 | B1 | 6/2010 | Spurgeon et al. | |
| 8,507,077 | B1 | 8/2013 | Bentley | |
| 8,522,989 | B2 | 9/2013 | Uptergrove | |
| 8,579,402 | B2 | 11/2013 | Uptergrove | |
| 8,667,895 | B2 | 3/2014 | Gerigk et al. | |
| 2002/0064616 | A1 | 5/2002 | Sawatsky | |
| 2004/0252174 | A1 | 12/2004 | Baxter et al. | |
| 2006/0144261 | A1 | 7/2006 | Uptergrove | |
| 2006/0158470 | A1* | 7/2006 | Vanheusden | B41J 3/4073 347/8 |
| 2008/0088653 | A1 | 4/2008 | Baker et al. | |
| 2008/0213518 | A1 | 9/2008 | Oyanagi | |
| 2008/0311285 | A1* | 12/2008 | Hirai | H05K 3/4069 427/97.2 |
| 2009/0008028 | A1 | 1/2009 | Reschke | |
| 2009/0097044 | A1* | 4/2009 | Zach | B41J 3/4078 358/1.8 |
| 2010/0086753 | A1 | 4/2010 | Johnson | |
| 2010/0096386 | A1 | 4/2010 | Uptergrove | |
| 2010/0272920 | A1* | 10/2010 | Garnett | B05D 3/067 427/551 |
| 2011/0216413 | A1 | 6/2011 | Szczepanowski | |
| 2011/0179959 | A1 | 7/2011 | Gerigk et al. | |
| 2011/0232514 | A1 | 9/2011 | Putzer et al. | |
| 2011/0261131 | A1* | 10/2011 | Eve | B41J 11/002 347/104 |
| 2012/0031548 | A1 | 2/2012 | Broad | |
| 2013/0019566 | A1 | 1/2013 | Schach | |
| 2013/0165269 | A1 | 6/2013 | Molinari | |
| 2014/0285600 | A1 | 9/2014 | Domeier et al. | |
| 2014/0302289 | A1 | 10/2014 | Duzy | |
| 2014/0315000 | A1 | 10/2014 | Okuno | |
| 2014/0320574 | A1 | 10/2014 | Kraus | |
| 2015/0062240 | A1* | 3/2015 | Kraus | B41J 2/16552 347/25 |
| 2015/0283751 | A1* | 10/2015 | O'Neil | B29C 47/043 264/308 |

FOREIGN PATENT DOCUMENTS

| | | |
|---|---|---|
| JP | H02-310575 | 12/1990 |
| JP | H07025113 | 7/1993 |
| JP | H07-081050 | 3/1995 |
| JP | 2008162645 | 7/2008 |
| JP | 2009226863 | 10/2009 |
| JP | 2012071469 A | 4/2012 |
| WO | WO2013/150505 | 10/2013 |
| WO | WO2014/013973 | 1/2014 |
| WO | WO 2015036334 | 3/2015 |

OTHER PUBLICATIONS

International Search Report and Written Opinion dated Jan. 14, 2016, 12 pgs, U.S. Appl. No. 14/935,472.

International Search Report and Written Opinion dated Mar. 8, 2016, 24 pgs, U.S. Appl. No. 14/935,471.

International Search Report and Written Opinion dated Mar. 8, 2016, 24 pgs, U.S. Appl. No. 14/93473.

All Office Actions, U.S. Appl. No. 14/935,473.

All Office Actions, U.S. Appl. No. 14/935,474.

All Office Actions, U.S. Appl. No. 13/935,472.

* cited by examiner

APPARATUS AND METHOD FOR DEPOSITING A SUBSTANCE ON ARTICLES

FIELD OF THE INVENTION

The present invention is directed to apparatuses and methods for depositing a substance onto an article, including apparatuses and methods of printing directly on three-dimensional articles, as well as the articles printed thereby or having a substance deposited thereon.

BACKGROUND

Various apparatuses and methods of printing are disclosed in the patent literature and on the internet. Patent publications disclosing apparatuses and methods of printing include: U.S. Pat. No. 6,135,654, Jennel; U.S. Pat. No. 6,699,352 B2, Sawatsky; U.S. Pat. No. 7,210,408 B2, Uptergrove; U.S. Pat. No. 7,467,847 B2, Baxter, et al.; U.S. Pat. No. 8,522,989 B2, Uptergrove; U.S. Pat. No. 8,579,402 B2, Uptergrove; U.S. Pat. No. 8,667,895 B2, Gerigk, et al.; and US Patent Application Publication Nos. US 2011/0232514 A1, Putzer, et al.; US 2013/0019566 A1, Schach; US 2014/0285600 A1, Domeier, et al.; and PCT Publication WO 2015/036334, Till. In addition, Xennia Technology has posted a video on You Tube entitled "Digital Outdoor Textile Printing" that shows a printing process on a moving banner material using a print mechanism that moves in an indexing manner. Other types of apparatuses and methods include the apparatus and method disclosed in U.S. Patent Application Pub No. US 2012/0031548 A1, "Apparatus and Method for Applying a Label to a Non-Ruled Surface", filed in the name of Broad.

A number of current efforts are being directed to printing, particularly inkjet printing, on three-dimensional articles such as bottles and the like. Current printing apparatuses may either be of the single pass or the multi-pass type. Single pass apparatuses have the advantage that they are faster than multi-pass apparatuses. Multi-pass apparatuses can achieve better quality, but since the print heads must pass over the article multiple times in an indexing fashion, they are slower than single pass apparatuses. Unfortunately, with current inkjet technology and current printing apparatuses, the quality of labels that can be formed by printing directly on three-dimensional articles is not as good as that formed on separately printed flat labels. Most of the efforts appear to be directed to attempting to improve the quality of single pass apparatuses. A need exists for improved apparatuses and methods of printing, particularly for printing on three-dimensional articles.

SUMMARY

The present invention is directed to apparatuses and methods for depositing a substance onto an article, including apparatuses and methods of printing directly on three-dimensional articles, as well as the articles printed thereby or having a substance deposited thereon.

In some cases, the apparatuses and methods involve creating a recirculating relative motion between at least one article and a substance deposition device. In some embodiments, the articles can be conveyed in a closed loop path past one or more substance deposition devices. The articles can be conveyed past the substance deposition device(s) one or more times, and during each pass by the substance deposition device(s), a portion of a predetermined pattern may be applied to the articles by the substance deposition device(s).

Figure 1:
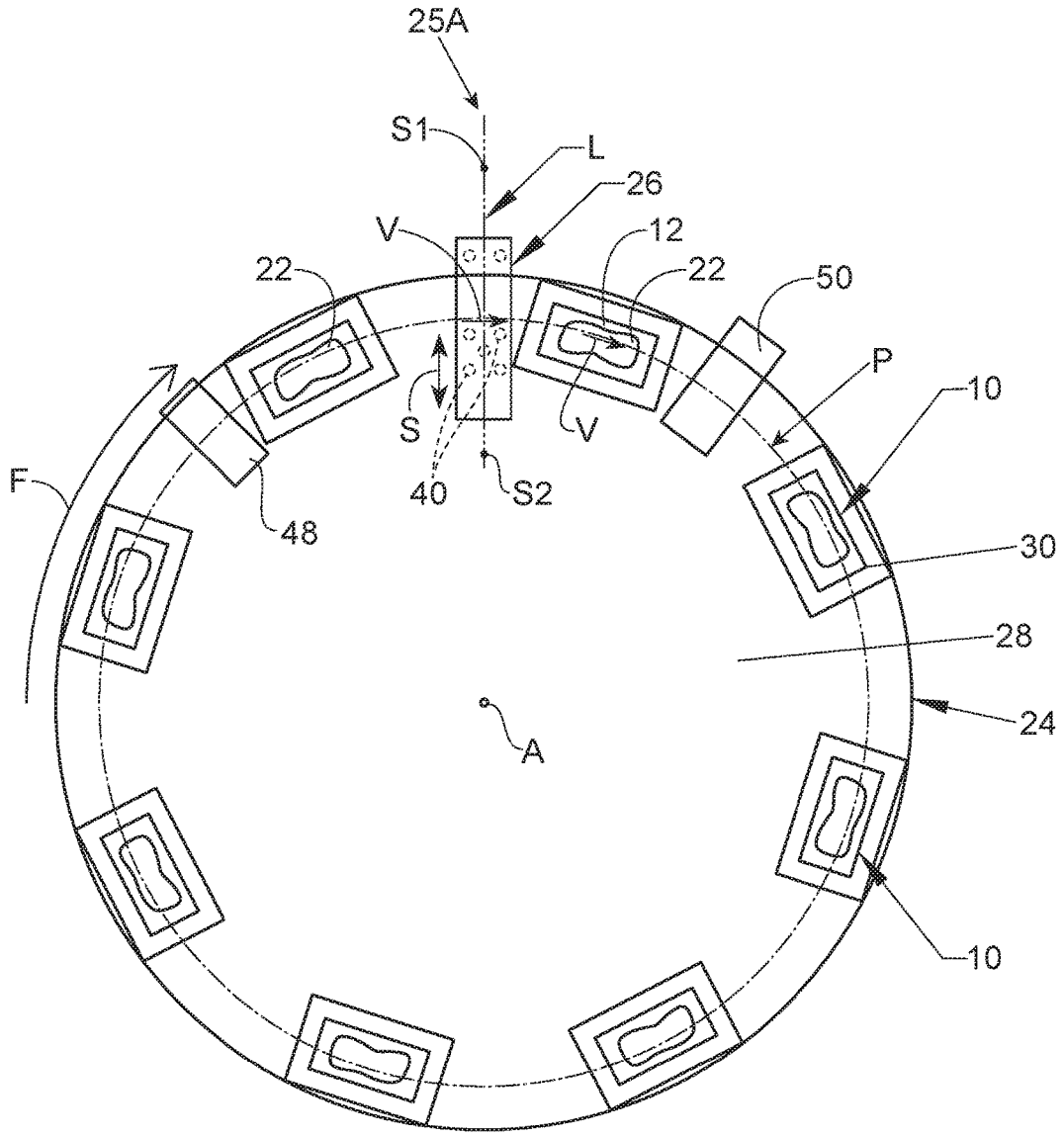
FIG. 1 is a schematic top view of one embodiment of an apparatus for depositing a substance onto an article.

The embodiments of the method, apparatus(es), and articles shown in the drawings are illustrative in nature and are not intended to be limiting of the invention defined by the claims. Moreover, the features of the invention will be more fully apparent and understood in view of the detailed description.

DETAILED DESCRIPTION

The present invention is directed to apparatuses and methods for depositing a substance onto an article, including apparatuses and methods of printing directly on three-dimensional articles, as well as the articles printed thereby or having a substance deposited thereon. The term "method" may be used interchangeably herein with the term "process".

Figure 2A:
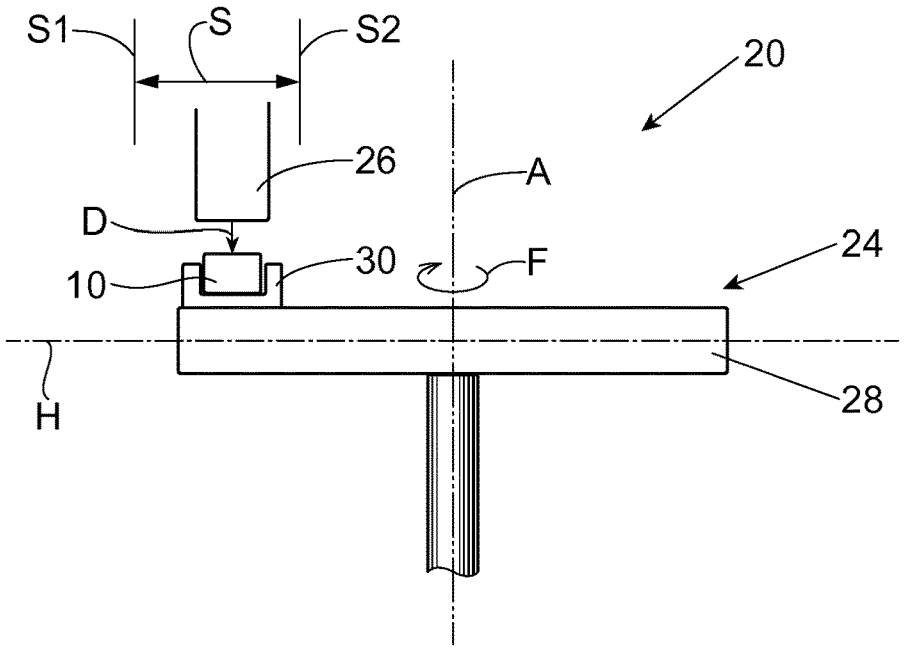
FIG. 2A is a schematic side view of an apparatus similar to that shown in FIG. 1.

FIGS. 1 and 2A show one non-limiting embodiment of an apparatus 20 for depositing a substance 22 on at least one article 10. As shown in FIGS. 1 and 2A, the apparatus 20 comprises an article conveyor 24 that conveys at least one article 10 past at least one station 25A at which a substance deposition device 26 is located. The term "conveyor", as used herein, refers to devices that move articles generally, and is not limited to conveyor belts.

The apparatus 20 can be used to deposit a substance or material 22 on numerous different types of three-dimensional articles 10. Such articles include, but are not limited to: caps, closures, bottles; boxes; cans; cartons; containers; laundry dosing balls; razors; components of consumer products such as razor blade heads and handles; sprayer triggers; tubs; tubes including, but not limited to tampon tubes; and deodorant stick containers. The articles may include primary packages for consumer products, including disposable consumer products. Additional articles include components of containers or packages including, but are not limited to: bottle caps; and bottle pre-forms that are subsequently blown into the form of a finished bottle. The apparatus 20 can be used to convey and print empty containers, partially filled, or full containers. The containers can have a rigid or flexible structure in whole or in part. Such containers may be capped or uncapped. The articles can be made of any suitable material, including but not limited to: plastic, metal, and/or cardboard.

The substance deposition device(s) ("deposition device") 26 can deposit any suitable substance (or "material") on the article 10. Suitable materials include, but are not limited to: inks (including UV-curable inks, and acrylate-based inks), coatings, and lotions. The material can be deposited in any suitable form. Suitable forms include, but are not limited to: liquids, powders, and hot melts (the latter being solids that may be heated to flow). The material can be deposited in any suitable pattern. Suitable patterns can be regular or irregular and include, but are not limited to: designs, images, text, an indicium, a texture, a functional coating, and combinations thereof. The deposition device 26 can be any suitable type of device including, but not limited to an inkjet print head, nozzles, and other types of material deposition devices.

The apparatus 20 and method may create one or more types of relative motion between the articles 10 and the deposition device(s) 26. The relative motion can be created by: (1) moving the article(s) 10 with respect to the deposition device 26; (2) moving the deposition device 26 relative to the article(s) 10; or by moving both the article(s) 10 and the deposition device 26 relative to each other. There may be more than one different type of relative motion between the article(s) 10 and the deposition device(s) 26. In cases in which the apparatus and method create more than one different type of relative motion between the articles and the deposition device, these will be referred to herein as a first type of relative motion, a second type of relative motion, etc.

The first type of relative motion, shown by arrow F in FIG. 1, can be provided for any suitable purpose. In certain non-limiting embodiments, the first type of relative motion is created when the conveyor 24 provides an at least partially non-linear motion of travel between the articles 10 and the deposition device 26. This type of relative motion can be provided in order to subject the article 10 to more than one cycle past (or "pass" by) the deposition device 26. The deposition device 26, in such a case, can be stationary or fixed relative to the ground; or, it can be movable (as described below). If the deposition device 26 is movable, it may have its movement limited to a particular direction and a particular amount. The article(s) 10 may pass by the deposition device 26 at least two times. The article(s) 10 can pass by the deposition device 26 any suitable number of times including, but not limited to: 2, 3, 4, 5, etc. times up to twenty or more times.

In some embodiments, the at least partially non-linear motion can be achieved by providing the article conveyor 24 in the form of a re-circulating loop. The re-circulating loop can be in any suitable configuration. The conveyor 24 may move (and, thus, move the articles 10) in a curvilinear path such as a circular path; or in a path that comprises both linear portions and curvilinear portions. Non-limiting examples of such paths include: circular paths, elliptical paths, race track configured paths, and other closed loop paths. The re-circulating loop comprises during at least a portion thereof, moving the article(s) 10 about an axis that is different from (e.g., offset from) the article's own axis. Thus, spinning the article about its own axis (such as spinning a can about its own axis on a mandrel), would not be considered to be a "re-circulating loop".

FIG. 1 shows one non-limiting embodiment of an apparatus 20 for depositing a substance 22 such as printing on at least one article 10. The articles 10 are moved along an arcuate path relative to the deposition device 26. More specifically, the conveyor 24 shown in FIG. 1 moves the articles 10 in a circular path P in a "turret" type rotating device. As shown in FIG. 1, the conveyor 24 has an axis of rotation A. The axis of rotation A may be oriented in any suitable orientation, including in a vertical orientation (so that the conveyor rotates like a carrousel), a horizontal orientation (so that the conveyor rotates like a Ferris wheel), or some orientation between horizontal and vertical.

The re-circulating loop allows the article(s) to be presented to the deposition device multiple times at a higher rate (articles per unit time) than a linear-moving carriage-type device to enable multi-pass deposition of material on the article(s) 10. For instance, one type of flatbed carriage-type device that uses two passes to deposit a substance on a three-dimensional article prints at a rate of 12 articles per minute. Depending on the size of the article(s), the method of the present invention may be capable of printing up to 60, or more, articles/minute.

Figure 2B:
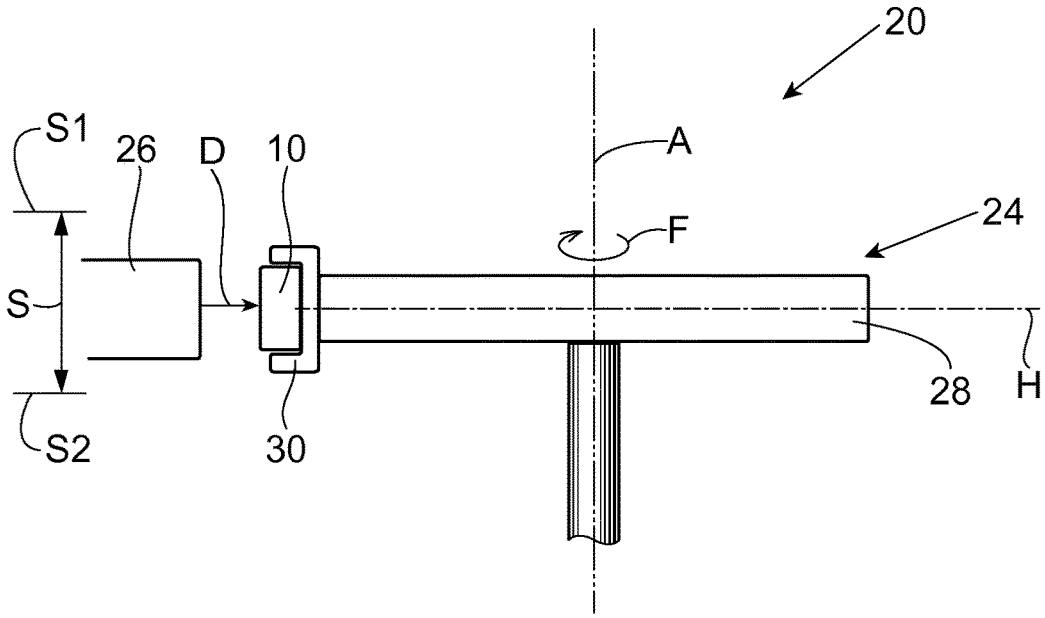
FIG. 2B is a schematic side view of an apparatus similar to that shown in FIG. 1, showing alternative locations for article holders and a deposition device.

The conveyor 24 can be any suitable type of device for conveying the article(s) 10 past the deposition device 26. Suitable conveyors include, but are not limited to: turret conveyors, star wheel conveyors, endless loop conveyors which may be in the form of tracks, belts, chains, and the like. As shown in FIGS. 1, 2A, and 2B, the conveyor 24 may comprise a carrier 28 and at least one optional holder 30 for an article 10 that is joined to the carrier 28. The term "joined to" encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. If there is more than one holder 30, the holders may be joined to the carrier 28 in any suitable arrangement. Suitable arrangements include, but are not limited to a radial array about a circular carrier 28.

As shown in FIGS. 1 and 2A, the carrier 28 may rotate in the direction of the large arrow F in a horizontal plane, H, about an axis A, which in this case is vertical. In FIG. 1, the direction of rotation F is clockwise. In other embodiments, the direction of rotation may be counter-clockwise. Typically, the conveyor 24 will rotate in the same direction (clockwise or counter-clockwise, as the case may be) between passes of the article(s) past the deposition device(s) 26. Thus, the conveyor 24 may, but will typically not rotate clockwise between one pass of the articles past the deposition device(s) 26, and then rotate counter-clockwise during another pass (or vice versa). The conveyor 24 may rotate at a constant velocity, or the velocity of rotation may be varied, if desired. The rotation of the conveyor 24 may be continuous, or if desired, intermittent. The article(s) 10 will have a vector, V, representing the direction of movement of (and velocity of) the article 10 at any given place along the path P which the article is conveyed.

As shown in FIGS. 1, 2A, and 2B, the deposition device 26 and the holders 30 can be in several possible positions relative to the carrier 28. In the embodiment shown in FIGS. 1 and 2A, it may be desirable for the deposition device(s) 26 to be disposed above the portion of the carrier 28 containing the holders 30 holding the articles 10. In FIG. 2A, the articles 10 will be moving in the horizontal plane H. When they are under the deposition device 26, the direction of movement V of the articles 10 is a perpendicular line that extends into the plane of the drawing figure. In such a case, the substance 22 will have a direction of application D that is substantially parallel to the vertical axis A, and substantially perpendicular to the plane in which the article is moving (which in this case, is the horizontal plane H). When it is said that direction of application D is substantially perpendicular to the horizontal plane H, the direction of application may, but need not be exactly perpendicular to the direction of article movement.

In other embodiments, as shown in FIG. 2B, the carrier 28 also rotates in a plane, such as in a horizontal plane H about a vertical axis A. In this embodiment, the articles 10 will also be moving in the horizontal plane H in a direction where V is a perpendicular line that extends into the plane of the drawing figure when they are adjacent the deposition device 26. However, in this embodiment, the direction of application D is parallel or substantially parallel to the horizontal plane H, and the article holder 30 is located on the side of the periphery of the carrier 28 so that the articles 10 will face the deposition device 26. In such a case, the articles 10 will be moving in the horizontal plane H and the substance 22 will have a direction of application D that is parallel to the horizontal plane H (instead of substantially perpendicular as in FIG. 2A). However, in this embodiment, the direction of application D is also perpendicular or substantially perpendicular to the direction of movement V of the article(s) (but in another manner in three-dimensional space) when the article is in position adjacent the deposition device 26 for the application of a substance to the article.

In other embodiments, the deposition device(s) 26 could be located inside the path of travel P of the articles 10. In addition, if the carrier 28 in either of the embodiments shown in FIGS. 2A and 2B is tilted so that it lies and rotates within a vertical plane (or in some plane oriented between horizontal and vertical), the direction of application D may still bear the same relationship to the plane of rotation described in those embodiments, but the plane of rotation will either be vertical or oriented between horizontal and vertical, as the case may be.

Figure 3:
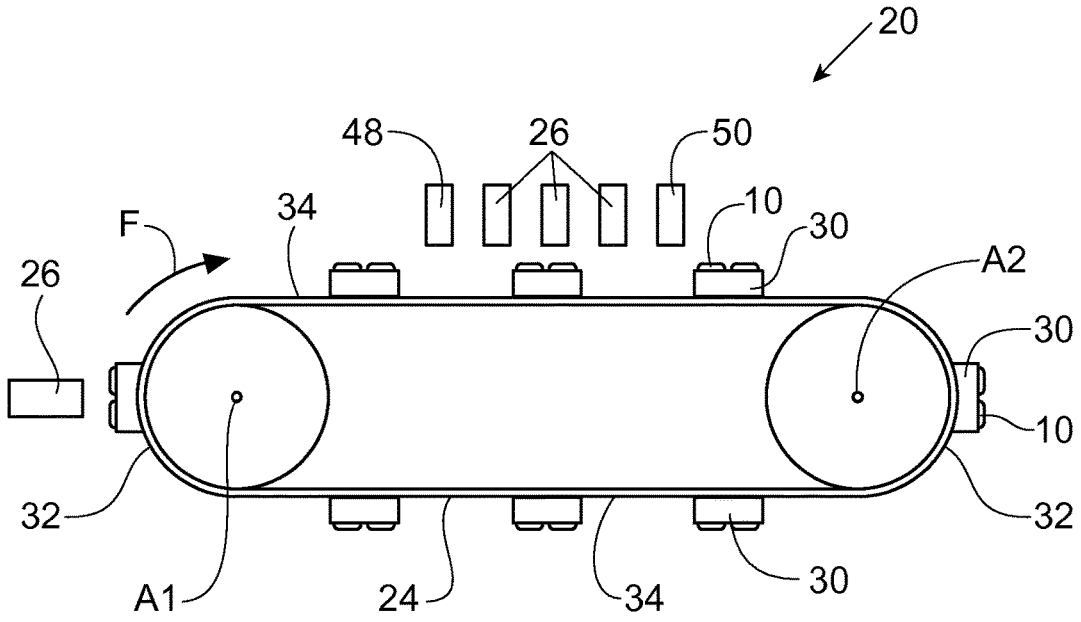
FIG. 3 is a schematic top view of another embodiment of an apparatus for depositing a substance onto an article.

FIG. 3 shows an alternative embodiment of an apparatus 20 for depositing a substance 22 on at least one article 10. In the embodiment shown in FIG. 3, the article conveyor 24 is in a race track configuration. This type of conveyor will have two parallel axes about which the conveyor 24 and the articles 10 rotate during at least a portion of the path of travel. These axes are designated A1 and A2. The apparatus 20 shown in FIG. 3 can have any of the properties described above with respect to the apparatuses shown in FIGS. 1, 2A, and 2B including, but not limited to its orientation (horizontal or vertical), and arrangement of the deposition device(s) 26 relative to the conveyor 24, and arrangement of any article holders 30 thereon. In such a race track embodiment, as shown in FIG. 3, it is possible to arrange the deposition device(s) 26 so that the article(s) 10 is moving either on a curvilinear path or a linear path past the deposition device(s) 26 depending on whether the deposition device(s) 26 is located at one of the ends 32 of the race track shaped path, or along one of the sides 34 of the race track shaped path. In either case, the path along which the articles 10 move is still in a continuous loop, and when the article(s) 10 are moved past a given deposition device 26 a second (or subsequent time), the article will be moving in the same direction as when it was moved past the deposition device 26 the first time. Thus, the article 10 may, but will typically not be moved in the opposite direction on each pass past the deposition device 26. For example, the article 10 may, but will typically not move clockwise on one pass, and counter-clockwise on another pass.

Figure 3A:
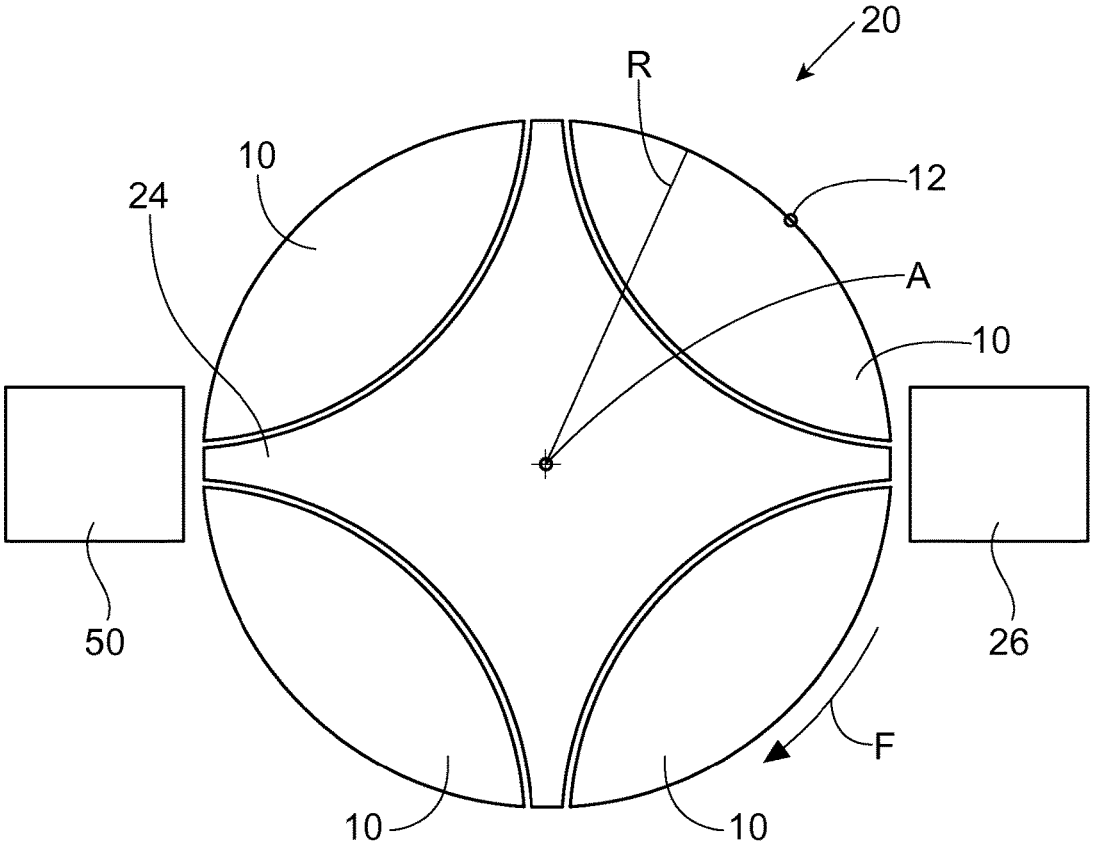
FIG. 3A is a schematic end view of another embodiment of an apparatus for depositing a substance onto an article.

FIG. 3A shows another alternative embodiment of an apparatus 20 for depositing a substance on at least one article 10. In the embodiment shown in FIG. 3A, the article conveyor 24 is substantially in the configuration of a cylinder, but has recesses therein which provide receptacles for at least one article 10. The conveyor 24 can be provided with 1, 2, to 20 or more receptacles. In the embodiment shown, there are four receptacles, each of which is shown with an article 10 therein. The receptacles can be of any configuration suitable for holding the article(s) 10. As shown in FIG. 3A, the conveyor 24 rotates about axis A, such as in the direction of arrow F. The conveyor 24 has a radius R. This embodiment is particularly useful when the portion of the surface 12 of the article 10 to have a substance deposited thereon has the same curvature, or substantially the same curvature as the substantially cylindrical conveyor 24. For example, that portion of the surface 12 of the article may have substantially the same radius as the radius R of the conveyor 24. (Thus, the outwardly-facing portions of the surface 12 of the articles 10 may, along with the conveyor 24 at least partially form (or completely form) a cylindrical surface.) The apparatus 20 may also have an optional device 50 for drying or curing the substance deposited on the articles. The drying or curing device 50 can be positioned at any suitable location relative to the conveyor 24, such as on the opposite side of the conveyor 24 relative to the deposition device 26.

The apparatus shown in FIG. 3A can otherwise, have any of the properties described above with respect to the apparatuses shown in FIGS. 1, 2A, and 2B including, but not limited to its orientation (horizontal or vertical), and arrangement of the deposition device(s) 26 and other stations relative to the conveyor 24. The substance deposition device 26 located adjacent to the conveyor 24 may also be movable. For example, the conveyor 24 may be spinning clockwise (or counter-clockwise), and the substance deposition device 26 may be movable longitudinally (parallel to axis A) inward (into the direction of the page) and/or outward. The apparatus shown in FIG. 3A may provide the advantage that it maintains the same distance between the surface 12 of the articles 10 and the deposition device without the is to move the deposition device 26 toward and away from the surface 12 of the articles 10 to adjust to the curvature of the same.

Thus, as shown and described above, the first type of relative motion F can be contrasted with current multiple pass printing processes and apparatuses that typically involve moving a carriage containing a print head linearly back and forth over an article and indexing the carriage or the article. The first type of relative motion F can also be contrasted with current multiple pass printing processes and apparatuses that hold the print head steady and index an article relative to the print head. Unlike indexing motions, in the case of the first type of relative motion F, the path along which the article(s) 10 move (and any axis defining the same) may remain fixed between cycles. Thus, neither the axis, nor the path P needs to shift between cycles.

The articles 10, if three-dimensional, will typically have at least two opposing ends. For example, a bottle will have a base and a top. The articles 10 may also have a front, a back, and sides. The articles 10 will also have a surface 12. The articles 10 may be solid as in the case of some razor blade handles, or hollow in the case of bottles, for example. If the articles are hollow, they will also have an interior. The surface of the articles 10 may be flat or curved. The entire surface need not be either flat or curved. For example, the surface of the articles 10 may have: portions that are flat; portions that are curved; or, the surface may have both flat portions and curved portions. For instance, in the case of bottles, at least a portion of the surface may have a convex curvature. It is also possible that some articles may have a surface in which a portion thereof has a concave curvature.

The method and apparatus are particularly useful for printing on articles with curved surfaces. The apparatus and method deposit the substance 22 on the surface of the article(s) 10. The apparatus and method are also particularly useful for printing directly on the surface of the article(s) 10. For instance, instead of attaching a pre-printed label to an article such as a bottle, the apparatus and method can be used to directly print the subject matter of the label on the article. Of course, the apparatus and method are not limited to printing subject matter which serves as a label on the articles. The apparatus and method are also useful in printing designs and the like on articles.

The articles 10 can be in any suitable orientation on the article conveyor 24. For example, the articles 10 may be situated in an upright orientation, or an upside down orientation on the conveyor 24 (and in any article holders 30). Alternatively, the articles 10 may lay flat on the conveyor 24 (and in any article holders 30). The only requirement is that the portion of the surface of the articles 10 on which the substance 22 is to be deposited should be exposed to the deposition device 26 at the time it is desired to deposit the substance 22 on the article 10.

The conveyor 24 can hold any suitable number of articles at a given time. Suitable numbers of articles 10 can range from 1-20, or more articles. If there are multiple articles on the conveyor at a given time, they may be referred to herein as a "batch" of articles. The batch of articles will typically all travel on the same path P, until the articles are removed from the conveyor 24 for subsequent processing. The number of articles 10 on the conveyor 24 at a given time may be less than, equal to, or greater than the number of deposition device(s) 26 disposed adjacent the conveyor 24. The apparatus 20 may, thus, provide a cost advantage in comparison to certain other apparatuses by using fewer deposition device(s) including, if desired, only one deposition device on the apparatus.

The deposition device 26, as discussed above, can be any suitable type of device including, but not limited to print heads, nozzles, and other types of material deposition devices. The deposition device 26 may be a non-contacting type of deposition device. By "non-contacting", it is meant that the deposition device 26 does not contact the surface of the article(s) 10 on which the substance 22 is to be deposited. In the case of print heads, any suitable type of print heads can be used including, but not limited to inkjet print heads, piezo print heads, electrostatic print heads and/or printing valve print heads. The print heads may be of a drop-on-demand type of deposition device. By "drop-on-demand", it is meant that the print heads can apply droplets of ink only where needed such as to form a pattern in the form of words, figures (e.g., pictures), or designs. Ink jet print heads are typically digitally actuatable and can print images provided by a computer.

Ink jet print heads will typically comprise multiple nozzles 40. As shown in FIG. 1, the print head has a length with a linear axis L. The nozzles 40 are typically generally aligned in rows and are configured to jet ink in a particular direction that is generally parallel to that of the other nozzles. The nozzles within each row on a print head can be aligned linearly. Alternatively, as shown in dashed line in FIG. 1, the nozzles 40 may be in one or more rows that are oriented diagonally relative to the longer dimension (or length) of the print head. Both such arrangements of nozzles can be considered to be substantially linearly arrayed. The inkjet print heads can comprise any suitable number and arrangement of nozzles therein. One suitable inkjet print head contains approximately 360 nozzles per inch (per 2.54 cm). The Xaar 1002 is an example of a suitable print head for use herein, and is available from Xaar of Cambridge, UK.

Figure 4:
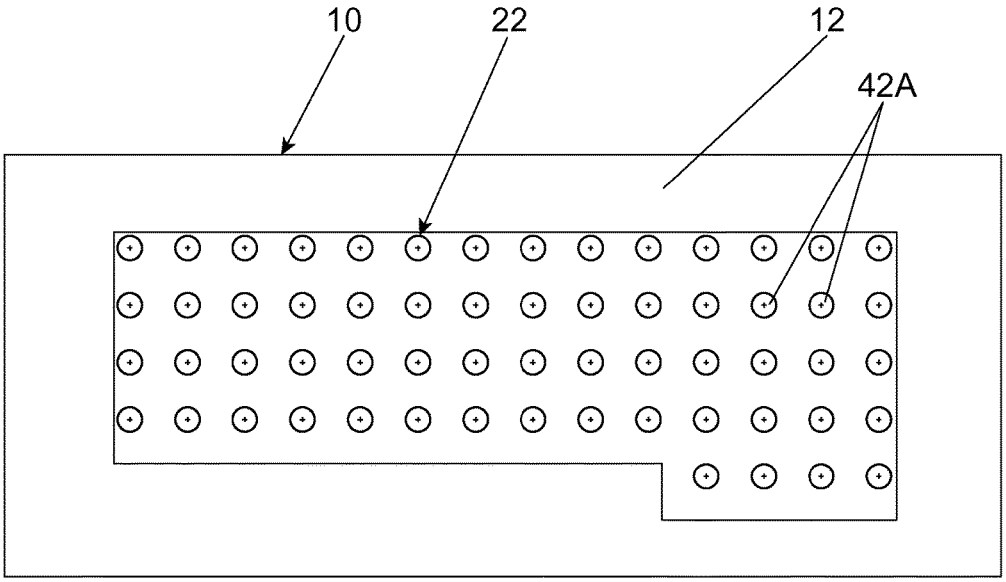
FIG. 4 is a schematic side view of the surface of a printed article showing a two-dimensional array of pixels that form only a portion of the total predetermined pattern to be printed thereon.
Figure 5:
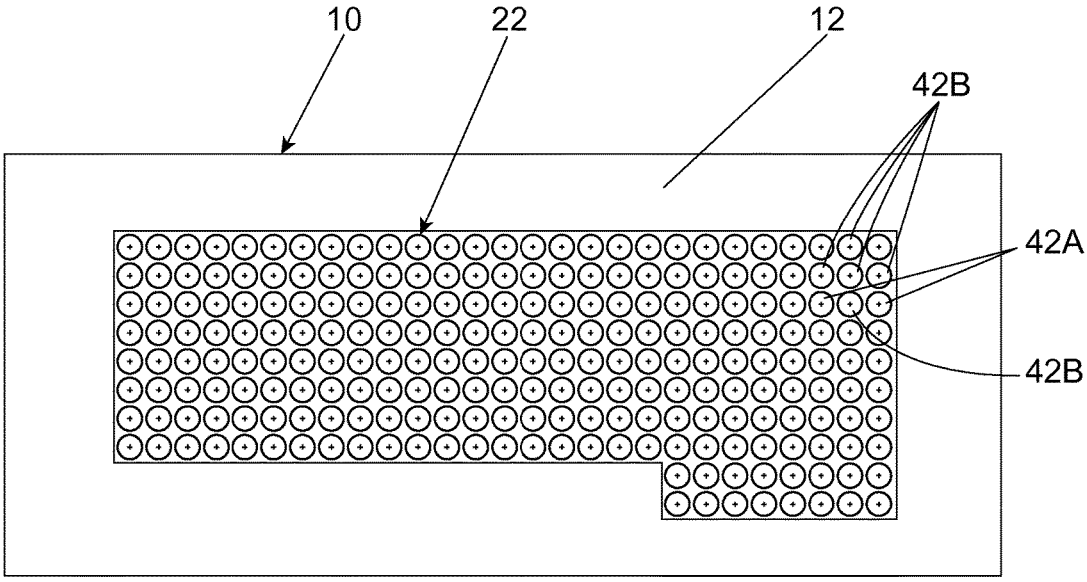
FIG. 5 is a schematic side view of the surface of a printed article showing a two-dimensional array of pixels that form the total predetermined pattern to be printed thereon.

The droplets of ink formed by an ink jet print head can range in diameter from about 10 microns or less to about 200 microns, or more. The droplets of ink can be distributed in any suitable number over a given area. Typically, in ink jet printing, the ink droplets form a matrix in which the number of drops per inch (DPI) is specified in the direction of movement of the print head or article to be printed, and in a direction on the surface of the article perpendicular thereto. A two dimensional representation of such a matrix of ink droplets 42 is shown in FIGS. 4 and 5. (It will be appreciated that in the process described herein, such an array may be formed on an at least partially three-dimensional (e.g., curved) surface.) The application of ink drops provided on the surface of the article to form a digital image can range from about 200, or less up to about 2,880 or more drops per inch (DPI) in at least one direction. In some cases, the droplets of ink can be deposited in a matrix that ranges from 1,080 to 1,440 drops per inch in at least one direction. In some cases, the droplets of ink may be deposited in a matrix that is greater than 1,200 drops per inch in at least one direction.

The apparatus 20 can comprise any suitable number, arrangement, and type of deposition device(s) 26. For example, the apparatus may comprise between 1-20, or more, deposition device(s) 26. Thus, there may be a plurality of deposition devices 26. The deposition device(s) 26 may be arranged in a spaced apart relationship along the article conveyor 24. Alternatively, one or more of the deposition device(s) 26 may be positioned adjacent and in contact with another one of the deposition device(s) 26. The deposition device(s) 26 may be positioned above the articles 10 in the article conveyor 24, or to either of the sides of the articles 10 that are inside or outside of the path of movement P.

When the deposition device(s) 26 comprise print heads, one or more of the deposition devices 26 may comprise a printing unit (or "printing station"). The ink jet print heads may be configured to print black, or color. Each printing unit may comprise any suitable number of print heads, from one to four or more. For example, in some cases, the printing unit may comprise four print heads for a CMYK (cyan, magenta, yellow, and key (black)) color scheme for producing different color sets of a multicolor print. The printing unit may also comprise additional print head(s) for additional colors, e.g., white and or special colors, for a priming coat as a first printing step or for a base layer, e.g., an adhesive, and/or for applying a transparent sealing or protective coating. In some embodiments, there may be multiple continuously re-circulating loops, such as one or more for a base coat, one or more for a decoration coat, and one or more for a top coat.

The apparatus 20 may further comprise one or more additional stations or devices that are positioned at any desired location along the conveyor 24. Such additional devices may include, but are not limited to pre-treatment devices 48 for pre-treating the surface of the articles, such as flame treatment, corona treatment, and plasma jet treatment devices. Such additional devices may also include devices 50 for drying or curing the articles after printing or other treatment (such as ultra-violet (UV) light sources or electron beam sources).

The substance, such as the ink(s) may be applied directly to the article(s) 10 in a predetermined pattern. The term "predetermined pattern", as used herein, refers to any type of printed pattern including but not limited to words, figures (e.g., pictures), or designs that is determined prior to the initiation of printing. As discussed above, an inkjet printed image is typically made up of a plurality of ink droplets that are arranged in a matrix of droplets or pixels.

The deposition device, such as print head(s) 26 may deposit only a portion of the predetermined pattern on each article 10 in each pass of the article past the deposition device 26. The portion of the predetermined pattern may take several possible forms. For instance, the predetermined pattern will typically cover a given area of the article. In some embodiments, a first portion of the total area of the pre-determined pattern (e.g., the upper half of an image) may be printed on the article during the first pass of the article past the print head(s) 26. Then, in a subsequent pass (such as the second pass), another portion (or the remainder of the image (such as the lower half)) of the image may be printed on the article. Of course, such embodiments are not limited to printing half of the image in one pass, and the other half in a second pass. Any suitable portion of the image can be printed in each pass in any suitable number of passes to form a complete image.

In other embodiments, as shown in FIGS. 4 and 5, the deposition device(s) 26 may be programmed to deposit a plurality of spaced apart material deposits such as ink droplets 42A that form a portion of the predetermined pattern on a first pass, and then on the second, and any subsequent passes, the deposition device(s) 26 can fill material deposits such as ink droplets 42B at least some of which are located in between the material deposits such as droplets 42A deposited on the first pass. Together, the portions of material such as ink deposited in the first pass and subsequent pass or passes make up the total predetermined pattern shown in FIG. 5. The patterns of ink droplets deposited in an embodiment such as shown in FIGS. 4 and 5 may be considered to be intermixed or interleaved. One advantage of intermixed or interleaved printing is that any defects in the printed image resulting from one or more of the nozzles on a print head not working will be less apparent than if the entire image is printed in a single pass with such defective nozzle(s).

The apparatus and method described herein is not limited to the examples shown in the drawings. It will be appreciated that the apparatus and method described herein allows any portion of any predetermined pattern to be applied to an article during each pass. In addition to printing any portion of the predetermined pattern of ink during each pass, the predetermined pattern could also comprise a base coat under the ink and/or a protective coat such as a clear coat disposed over the ink. In such cases, if desired, the base coat may be applied under all, or only a portion of the predetermined pattern of ink. Likewise, if desired, the clear coat may be applied over all, or only a portion of the predetermined pattern of ink.

In some embodiments, in order to deposit different portions of the predetermined pattern, the apparatus and method may create more than one type of relative motion between the articles 10 and the deposition device 26. For instance, the print head(s) 26 may move relative to the article(s) 10 in order to align with a different portion of the article(s) 10 between passes such as between the first and second (or subsequent) pass of a given article 10 past the print head 26. The print head(s) 26 may move in any suitable manner relative to the article(s), with any suitable type of movement.

FIGS. 1, 2A, and 2B show the direction of such a second type of relative motion, S. In certain embodiments, in addition to the recirculating motion of the conveyor (the first type of relative motion), the second type of relative motion S may involve moving the substance deposition device, such as the print head(s) 26, in a direction that is substantially perpendicular to the direction of application D of the substance on the article. In the embodiment shown in FIGS. 1 and 2A, the direction of second type of relative motion S is parallel to the plane H. In the embodiment shown in FIG. 2B, the direction of second type of relative motion S is parallel to the axis A and perpendicular to the plane H. In both cases, when the substance is being applied to the article, the direction of second type of relative motion S is substantially perpendicular to the direction of article movement and velocity V (in one sense in three-dimensional space).

The substance deposition device 26 may move between one position such as S1 and another position, such as S2. In some embodiments, if the deposition device 26 is an ink jet print head, the positions S1 and S2 may be established such that when the deposition device 26 is at these positions, the ink nozzles 40 will be positioned entirely outside of one side of the area on the surface of the article 10 that is to be provided with the predetermined pattern. In such an arrangement, when the print head 26 is moved with respect to the article 10, all of the nozzles will be capable of applying ink to the article 10 from one side of the area on the surface of the article 10 that is to be provided with the predetermined pattern to the opposite side of the area to be provided with the predetermined pattern. Of course, S1 and S2 can be set so that the deposition device 26 will move to any suitable extent with respect to the article(s) 10.

In some cases, the print head(s) 26 may print while moving at least part of the distance between one position such as S1 and another position S2 when an article 10 is in position adjacent thereto for receiving a substance such as ink thereon. In some cases, the print head(s) 26 may print while continuously moving from one position to another position when an article 10 is in position for receiving a substance such as ink thereon. In other cases, the print head 26 may index between subsequent passes of a given article 10 past the print head 26 before it starts printing again. In other words, the print head 26 may move or shift a certain distance in a direction substantially parallel to the axis of the nozzles L between subsequent passes of a given article 10 past the print head 26. In the case of an indexing print head 26, the print head 26 may be stationary when printing.

Other types of relative motion are also possible. For example, in certain embodiments, it may be desired to move the article 10 in order to present a different portion of the article to the deposition device 26. For instance, the article 10 could be turned or rotated in any suitable manner between the first and subsequent pass of a given article 10 past the print head 26.

If there is more than one deposition device 26, one or more deposition devices may be movable and one or more deposition devices may be stationary. If there is more than one movable print head 26, the different print heads 26 may all move with the same type of movement. Alternatively, certain print heads 26 can move with one type of movement, and other print heads 26 can move with a different type of movement.

If desired, the surface of the article can be treated prior to printing. Common surface treatment techniques include flame treatment, corona treatment, and plasma jet treatment. If desired, the deposited material 22 may be cured after any pass, including after each pass. For example, if the substance 22 is a UV-reactive ink, such an ink could be cured after one or more passes by exposure to UV light or an electron beam.

After the desired predetermined image is applied to the article(s) 10, the article(s) in the batch of articles may be transferred by the conveyor 24 to another conveyor or apparatus for further processing. For example, if the article(s) 10 are bottles, the bottles may be transferred from the conveyor 24 to a filler, and capper.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "90°" is intended to mean "about 90°".

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A continuous process for depositing a substance onto an article in a predetermined pattern, the process comprising:

providing a non-contacting substance deposition device;

providing at least one three-dimensional article which has a surface;

providing a conveyor configured to transport the at least one article in a continuous closed loop path past said substance deposition device at least twice;

creating a continuous re-circulating relative motion between the at least one article and the substance deposition device, such that the at least one article passes by the substance deposition device at least two times; and during the continuous relative motion, for each of the at least one articles, depositing a substance onto at least a portion of the surface of the article by using the device, wherein in each pass, the deposition device deposits only a portion of the total predetermined pattern to be formed, and the article is passed by the device at least twice to form the predetermined pattern.

2. The process of claim 1, wherein in each pass, the at least one article passes the deposition device while moving in the same direction.

3. The process of claim 1, wherein the deposition device is a drop on demand device.

4. The process of claim 1, wherein when an article is positioned to have a substance deposited thereon at the deposition device, the article is moving in a direction at a velocity, and the deposition device moves continuously in a direction substantially perpendicular to the direction of movement of the article.

5. The process of claim 1, wherein when an article is positioned to have a substance deposited thereon at the deposition device, the article is moving in a direction at a velocity, and the deposition device indexes between passes in a direction substantially perpendicular to the direction of movement of the article.

6. The process of claim 1, wherein there are multiple continuously re-circulating loops,one each for a base coat, a decoration coat, and a top coat.

7. The process of claim 1, wherein the substance is cured between passes.

8. The process of claim 1, wherein the conveyor comprises at least one article holder joined to the conveyor that is used to secure the at least one article.

9. The process of claim 1, comprising providing a batch of articles on the re-circulating path that all travel on the same path.

10. The process of claim 1, wherein the device is an inkjet print head.

11. The process of claim 1, wherein the at least one article is a consumer product or a component thereof.

12. The process of claim 1, wherein the at least one article is a primary package for a disposable consumer product.

13. The process of claim 1, wherein:

providing the at least one article comprises providing a group of articles;

said conveyor comprises a carrier having article holders joined thereto in an at least partially radial array; and at least a portion of the relative motion is circular.

14. The process of claim 1, wherein:

providing the at least one article comprises providing a group of articles;

said conveyor comprises a track in the configuration of a loop, having article holders joined to the track; and the relative motion is provided by moving the article holders around the loop.

15. The process of claim 9, wherein the articles in the batch move in substantially planar motion.

16. The process of claim 15, wherein the articles move in a substantially horizontal plane.

17. The process of claim 15, wherein the articles move in a substantially vertical plane.

18. The process of claim 1, wherein the relative motion is created, at least in part, by moving the article with respect to the deposition device.

19. The process of claim 1, wherein during the relative motion, the deposition device remains substantially stationary.

20. The process of claim 1, wherein each time the article passes by the deposition device, a portion of the predetermined pattern of the substance is deposited onto at least a portion of the surface of the article.

21. The process of claim 1, wherein substance is a material that is curable with ultra-violet light.

22. The process of claim 1, wherein the substance is an acrylate-based ink.

23. The process of claim 1, wherein:

the step of providing a substance deposition device comprises providing a plurality of non-contacting, depositing-on-demand, substance deposition devices;

the step of providing at least one three dimensional article comprises providing a batch of three dimensional articles;

the step of creating a re-circulating relative motion between the articles and the substance deposition devices comprises passing the batch of articles by the substance deposition devices at least two times in the same direction; and the step of depositing the substance comprises, during the relative motion, for each of the articles in the batch, depositing material onto at least a portion of the surface of the articles by using the devices, wherein in each pass, the deposition devices deposit only a portion of the total predetermined pattern to be formed, and the articles are passed by the devices at least twice to form the predetermined pattern.

24. The process of claim 23, wherein at least some of the substance deposition devices comprise inkjet print heads.

25. The process of claim 24, wherein:

at least some of the inkjet print heads are color inkjet print heads that are configured to print color; and the step of depositing the substance comprises depositing portions of the pattern of the substance, at least some of which portions are printed color portions, by using the color inkjet print heads, wherein the multiple portions form the predetermined pattern.

26. The process of claim 24, wherein:

at least one of the inkjet print heads is configured to print a white base coat; and the step of depositing the substance comprises depositing a portion of the predetermined pattern of the material, at least one of which portions is a white base coat, by using the inkjet print head configured to print a white base coat.

27. The process of claim 24, wherein:

at least one of the inkjet print heads is an inkjet print head that is configured to print a clear coat; and the step of depositing the substance comprises depositing portions of the predetermined pattern of the material, at least one of which portions is one of a clear primer coat, or a clear top coat, by using the inkjet print head configured to print a clear coat.

28. The process of claim 1 wherein said three-dimensional article is a container.

29. The process of claim 28 wherein said container is at least partially filled with contents contained therein.

30. The process of claim 1 further comprising a step of transferring the article by the conveyor to another conveyor or apparatus for further processing after forming said predetermined pattern on said article.

31. A process for depositing a substance onto an article in a predetermined pattern, the process comprising:

providing a non-contacting substance deposition device;

providing at least one three-dimensional article which has a curved surface a portion of which has a first radius;

providing a cylindrical conveyor having a second radius that is substantially the same as the first radius, the cylindrical conveyor configured to transport the at least one article in a closed loop path past said substance deposition device at least twice, wherein the curved surface of the three-dimensional article that has the first radius is presented toward the non-contacting substance deposition device and is disposed generally along the second radius of the cylindrical of the conveyor such that the portion of the curved surface having the first radius is located at a constant distance from the deposition device as it is presented to the deposition device;

creating a re-circulating relative motion between the at least one article and the substance deposition device, such that the at least one article passes by the substance deposition device at least two times; and during the relative motion, for each of the at least one articles, depositing a substance onto at least a portion of the curved surface of the article by using the device, wherein in each pass, the deposition device deposits only a portion of the total predetermined pattern to be formed, and the article is passed by the device at least twice to form the predetermined pattern.

* * * * *